United States Patent [19]

Jennrich et al.

[11] Patent Number: 4,802,349

[45] Date of Patent: Feb. 7, 1989

[54] HORIZONTAL BED POWER ASSIST HIDE APPLICATOR

[75] Inventors: Carleton E. Jennrich, Welch; Rudolph O. Marohl, Red Wing; Robert J. Weber, Hastings, all of Minn.

[73] Assignee: Sargent Sub (Delaware), Inc., Red Wing, Minn.

[21] Appl. No.: 74,686

[22] Filed: Jul. 17, 1987

[51] Int. Cl.[4] ..... C14B 1/02; C14B 1/58

[52] U.S. Cl. ..... 69/39; 69/40; 69/45; 69/19

[58] Field of Search ..... 69/19, 37, 39, 40, 45, 69/46

[56] References Cited

U.S. PATENT DOCUMENTS

| | | | |
|---|---|---|---|
| 157,691 | 12/1874 | Lockwood | 69/46 |
| 179,928 | 7/1876 | Lockwood | 69/46 |
| 240,997 | 5/1881 | Goodman | 69/46 |
| 569,843 | 10/1896 | Smith | 69/39 |
| 835,305 | 11/1906 | Lawrence | 69/40 |
| 3,675,450 | 7/1972 | Schwaller et al. | 69/45 X |
| 4,596,124 | 6/1986 | Korpi et al. | 69/40 |

FOREIGN PATENT DOCUMENTS

| | | | |
|---|---|---|---|
| 396520 | 6/1924 | Fed. Rep. of Germany | 69/37 |

*Primary Examiner*—Wm. Carter Reynolds

*Attorney, Agent, or Firm*—Burd, Bartz & Gutenkauf

[57] ABSTRACT

A mechanized power assisted apparatus for flattening and stretching wet tanned hides on a smooth flat horizontal bed of a vacuum hide drier preparatory to drying in the course of leather manufacture. The apparatus includes a support holding a squeegee-type slicker element for positioning closely adjacent to a hide-carrying drier bed. The slicker element has a smooth straight edge which is rotatable in a plane parallel to the surface of the plate. The slicker support is associated with a power travel drive system for moving the support in a plane parallel to and spaced from the surface of the hide-carrying bed and over a hide supported on that bed. A power thrust system is associated with the slicker element for moving the element into and out of contact with the wet hide and for exerting force on the slicker element. Spaced apart controls are provided for actuating the power assist systems for manipulating the slicker element over the surface of a hide in simulation of manual hide application.

25 Claims, 11 Drawing Sheets

FIG. 8
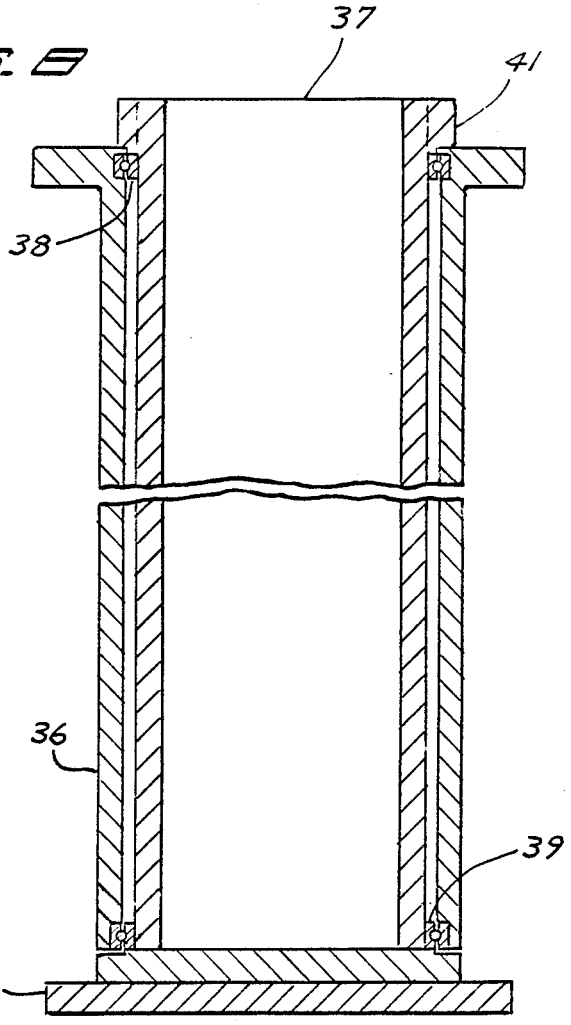
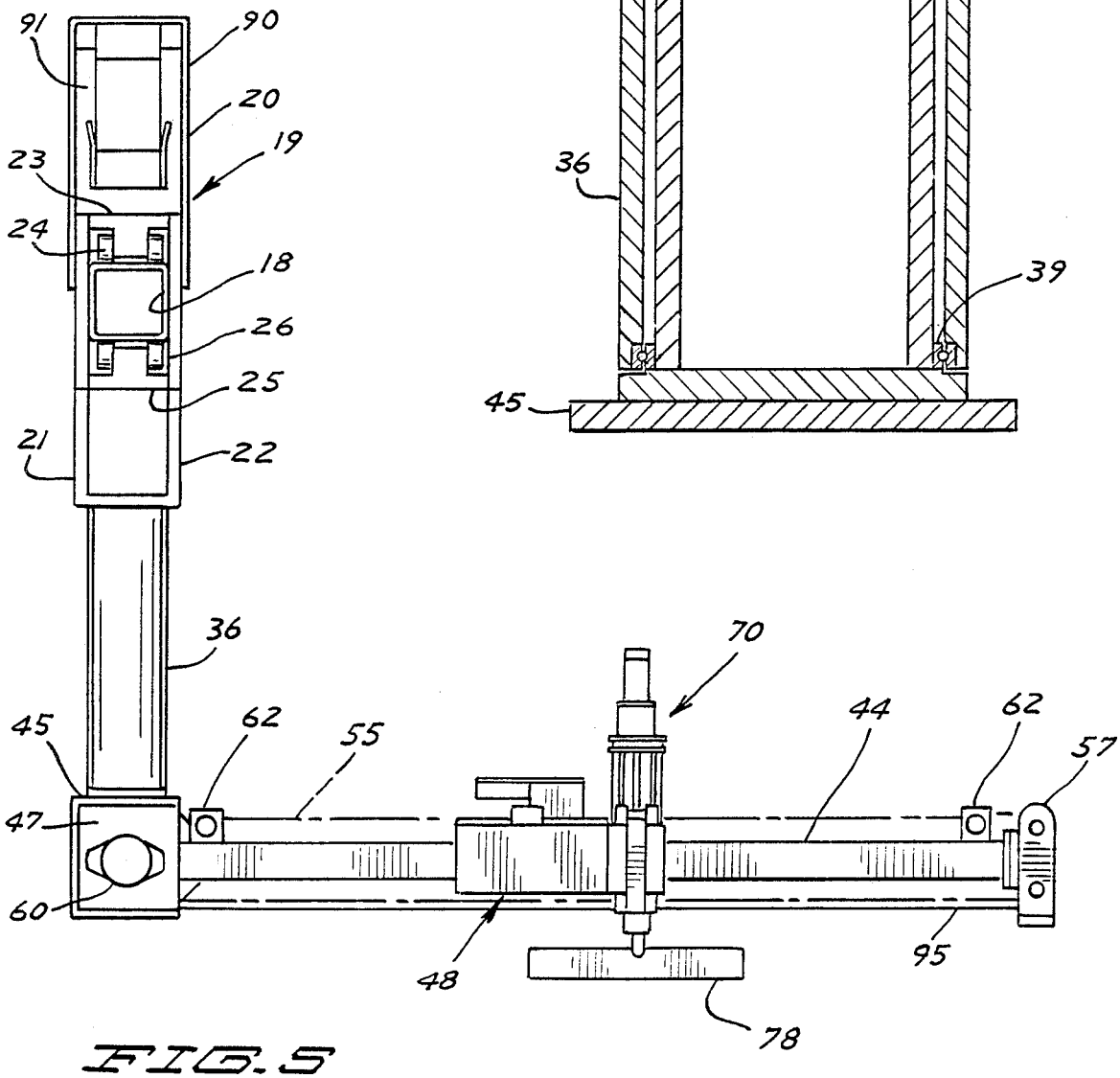
FIG. 5

HORIZONTAL BED POWER ASSIST HIDE APPLICATOR

BACKGROUND OF THE INVENTION

1. Field of the Invention

This invention relates to a mechanized power assisted apparatus for applying tanned hides on a smooth flat plate preparatory to drying in the course of leather manufacture.

Tanning of leather is an ancient art. From the earliest times, man has changed rough raw animal hides into supple wearable materials. This involves mechanical and chemical treatment of the hide to remove blood, lymph, adhering flesh, hair, etc. and enzymatic and bacterial action to render the hide soft and supple. These are wet treatments. The leather is commonly dyed and treated with oils and fats for lubrication, softness, strength and water-proofing. After dyeing and fat-liquoring, leather contains about 45 to 60 per cent water and is commonly dried to about 14 percent moisture. Chemical and physical reactions take place during drying. Loose tannins, dyes and oils spread uniformly, penetrate deeply and are firmly fixed. Uneven drying causes migration of unfixed tannin, dye and oil to the surface, resulting in undesirable dark stains and non-uniform appearance.

A common industry technique of drying wet hides has been so-called "paste drying." Hides are literally pasted by the grain side to large flat plates of adhesive coated glass, porcelain or metal, and then are passed through a tunnel dryer. After drying to the desired moisture content, the hide is stripped off yielding flat, smooth grain, large area leather sheets ready for finishing and fabricating into various leather goods. Alternatively, the wet hides may be vacuum dried after being similarly spread out on a flat smooth polished plate.

Whether to be paste dried or vacuum dried, it is essential that the wet hide be in intimate contact with the smooth planar surface without any entrapped air bubbles. The wet hide is applied to the surface and manually smoothed by means of a squeegee-type slicker element. This is most commonly in the form of a flat edged blade which is manipulated over the surface of the wet hide from the center to the edge working out any entrapped air or water between the hide and plate surfaces. At the same time, the hide is stretched somewhat increasing its area. This is tough, arduous work requiring great strength and staying power. Typically, in the course of a day's work, fatigue sets in toward the end of the day and productivity is materially reduced.

Vacuum drying is faster, requires costly equipment and is somewhat less productive. Vacuum driers utilize flat horizontal beds. To slick the hide the operator must reach in from the edge of the bed. It is difficult to exert force on the hide when the slicker is held at arm's length. Because of this the hide is less uniform and is not stretched as much, compared to use of a vertical plate all areas of which may be closely approached. In spite of the somewhat reduced yield in hide area, the industry trend is toward greater and greater use of horizontal bed vacuum driers. The principal objective of the present invention is to provide a mechanical power assisted apparatus to perform the back-breaking task of slicking hides on a horizontal bed, with its attendant advantages of lessened fatigue, higher productivity, and more uniform product, overcoming the disadvantages of current vacuum drying practices.

2. The Prior Art

U.S. Pat. No. 4,596,124, issued June 24, 1986, discloses a power assist hide applicator apparatus for flattening and stretching a wet hide against a smooth vertical planar surface for drying. The apparatus is adapted for positioning closely adjacent to the smooth flat vertical plate upon which a hide is adhered for drying according to conventional tanning practice. The apparatus comprises support means holding a slicker element for positioning closely adjacent to a hide-carrying plate. The slicker element has a smooth flat edge which is rotatable in a plane parallel to the surface of the plate. The slicker element support means is associated with a power assisted travel means for moving the support means in a plane parallel to and spaced from the surface of the hide-carrying plate and over an area substantially coextensive with the area of a hide supported on that plate. Power assisted thrust means are associated with the slicker element for moving the element on a horizontal path perpendicular to the vertical hide-carrying plate into and out of contact with a wet hide carried on the plate and for exerting force on the slicker element. Spaced apart manually operable control means are disclosed for actuating the power assist means for manipulating the slicker element over the vertical surface of a hide in simulation of manual hide application.

SUMMARY OF THE INVENTION

Broadly stated, the present invention is directed to a power assist hide applicator apparatus for flattening and stretching a wet hide against the smooth horizontal planar surface of the flat bed of a vacuum hide drier. The apparatus is adapted to be positioned adjacent to the flat bed of a vacuum drier as used for drying of hides according to conventional tannery practice.

The apparatus includes an elongated horizontal arm which is rotatable into position above and closely adjacent to the upper surface of the drier bed and functions as a slicker support. This horizontal arm may be in the form of a straight rigid horizontal track, or a telescoping tube, or the arm may be articulated with one or more joints. Support means adapted for positioning adjacent to the bed of a vacuum drier are provided for the horizontal arm. Depending upon the size and configuration of the vacuum drier with which the hide applicator apparatus is used, the support means may be a fixed or movable floor supported pedestal standard, or a frame adapted to be mounted above or positioned alongside of the vacuum drier. Means are provided for rotating the horizontal arm relative to the support means both for maneuvering the slicker element over the surface of a hide to be applied to the drier bed, and to permit the arm to be swung out of the way of the drier apparatus during vacuum drying.

A slicker element is supported from the horizontal arm. The slicker element has a smooth straight edge which is rotatable in a plane parallel to the surface of the drier bed. Separate motor means are provided for rotating the slicker element. Further separate independent power thrust means are associated with the slicker element for moving the element into and out of contact with a wet hide carried on the drier bed and for exerting force on the slicker element to permit smoothing and stretching of the hide.

Electric control means are provided for actuating the several motor power assist means for manipulating the slicker element over the surface of a hide in simulation of manual hide application.

BRIEF DESCRIPTION OF THE DRAWINGS

The invention is illustrated in the accompanying drawings in which correspondig parts are identified by the same numerals and in which:

FIG. 1 is a perspective view of a power assist hide applicator according to the present invention shown mounted on the top of one form of typical vacuum hide drier;

FIG. 6 is a side elevation on a further enlarged scale of the support carriage of the carriage assembly;

FIG. 8 is a vertical section through the boom tube of the carriage assembly;

FIG. 17 is a perspective view of an alternative form of hide applicator wherein the carriage support frame is mounted below the drier bed.

DETAILED DESCRIPTION OF THE PREFERRED EMBODIMENT

Figure 2:
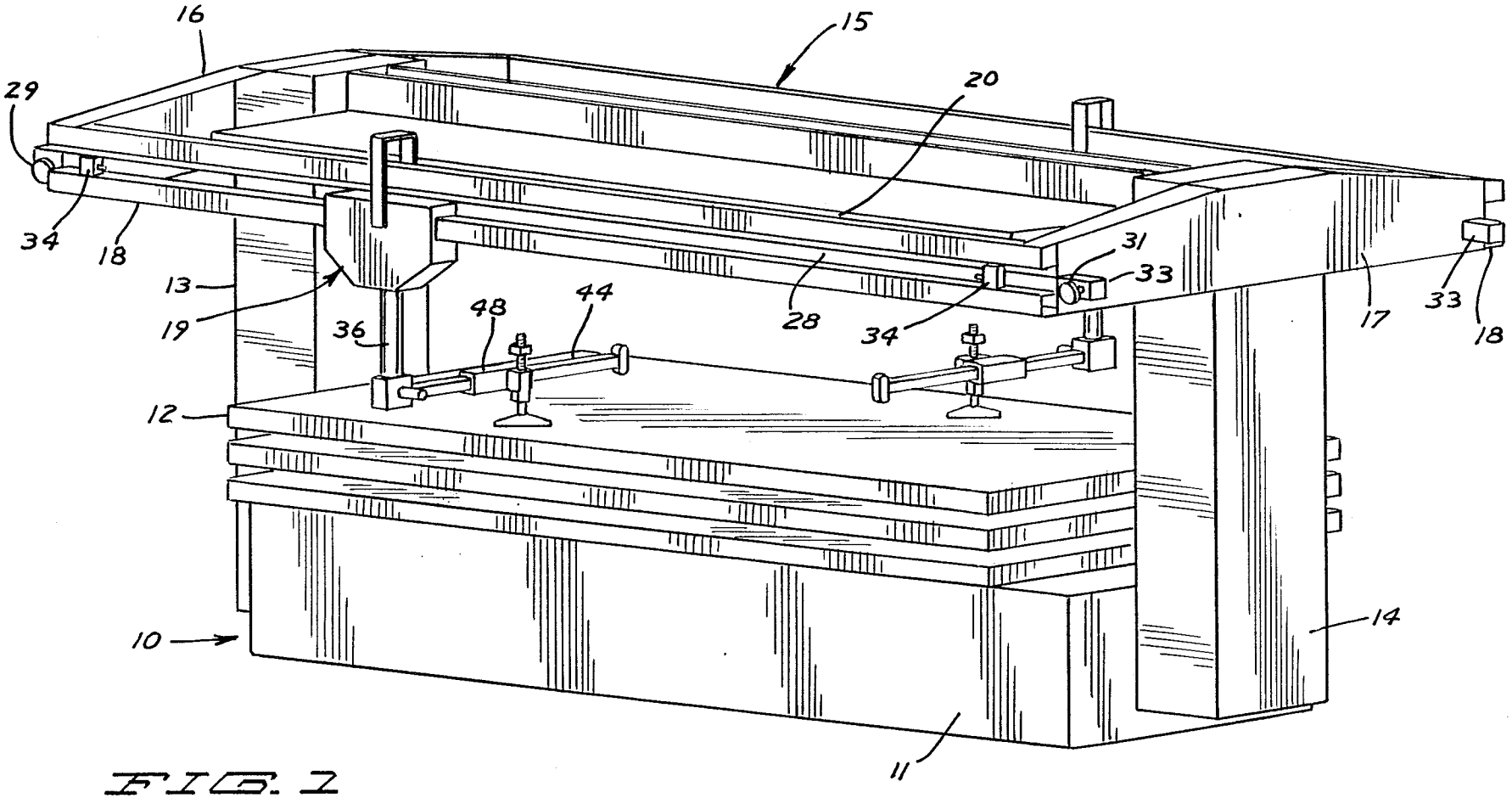
FIG. 2 is a top plan view thereof on a reduced scale.
Figure 2:
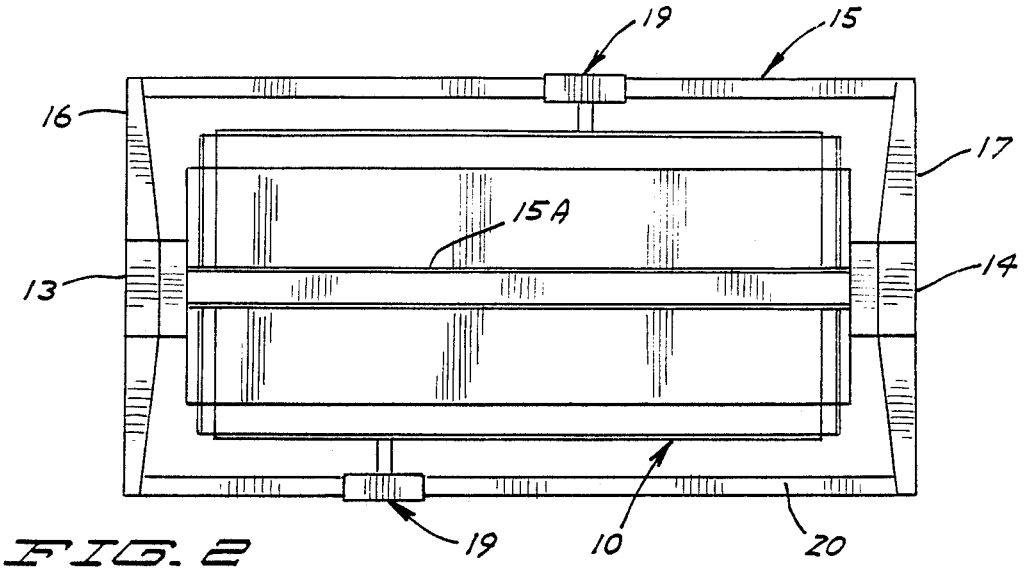
Figure 3:
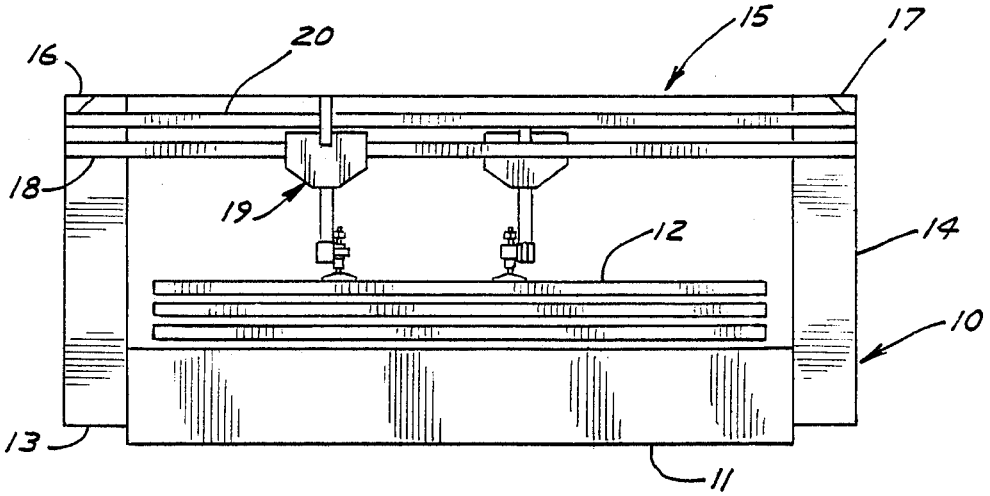
FIG. 3 is a left side elevation thereof.
Figure 4:
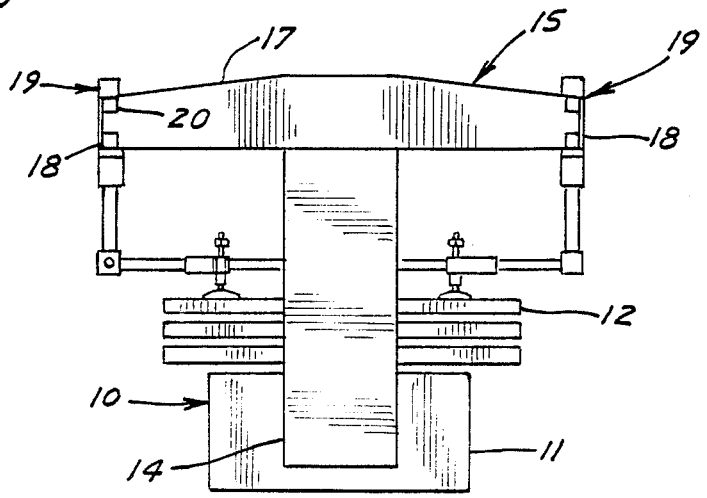
FIG. 4 is an end elevation thereof.

Referring now to the drawings, and particularly to FIGS. 1 through 4, there is shown one form of apparatus according to the present invention in conjunction with one form of typical horizontal bed vacuum hide drier. The drier shown is adapted for simultaneous drying of four large hides per bed. It is one of the largest vacuum driers used in the tanning industry. The typical vacuum drier shown, indicated generally at 10, comprises a horizontal base housing 11 enclosing heating, vacuum and condensing circuits and associated equipment for drying hides. Each dryer includes one or more flat rectangular bed or table 12, made for example of stainless steel sheeting, and having a smooth top surface upon which a wet hide is applied for drying.

Each bed or table includes appropriate heating members and an overlying vacuum hood is provided for each bed. In the typical embodiment shown, the vacuum hood for the lowermost bed is carried on the under side of the next adjacent bed, and so on, with a separate vacuum hood for the topmost bed 12. The typical vacuum drier 10 also includes a pair of vertical housings 13 and 14 enclosing lifting apparatus for the flat beds 12, along with flexible couplings to the equipment comprising the heating, vacuum and condensing circuits.

The details of construction of vacuum driers are well known in the industry and form no part of the present invention. A typical vacuum hide drier of the type shown is that which is commercially available from Officiene di Cartigliano, S.P.A., of Vicenza, Italy.

The apparatus of the present invention comprises a rectangular frame indicated generally at 15 adapted to be rigidly secured above and parallel to the flat beds 12 of the vacuum drier 10. Frame 15 includes a pair of transverse horizontal beams 16 and 17 each adapted to rest upon and to be secured to vertical housings 13 and 14, respectively, of the vacuum drier 10. Frame 15 also includes a pair of elongated horizontal longitudinal parallel beams 18, supported by cross beams 16 and 17, which function as tracks for carriage assemblies indicated generally at 19, as hereinafter described in greater detail.

It will be noted that frame 15 as illustrated is horizontally disposed, rectangular and dimensionally is generally proportionate to the beds 12 of the vacuum drier. However, the dimensions of frame 15 are somewhat greater than those of bed 12 such that tracks 18 are spaced outwardly from the side edges of the bed 12. This is to permit the slicker mechanism supported from carriage 19 to be swung out of the vertical paths of movement of beds 12 during operation of the drying cycle. Overlying each track/beam 18 and supported by cross beams 16 and 17, is a trough or tray 20 adapted to contain electrical wires and cables, air or hydraulic hoses and the like for controlling operation of the elements of the carriage assembly.

Figure 7:
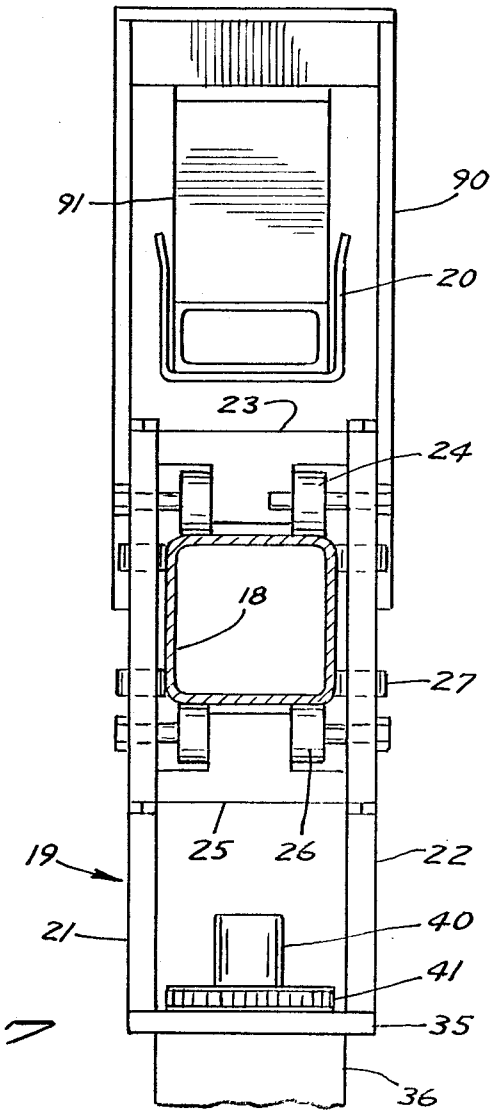
FIG. 7 is an end elevation thereof.
Figure 5:
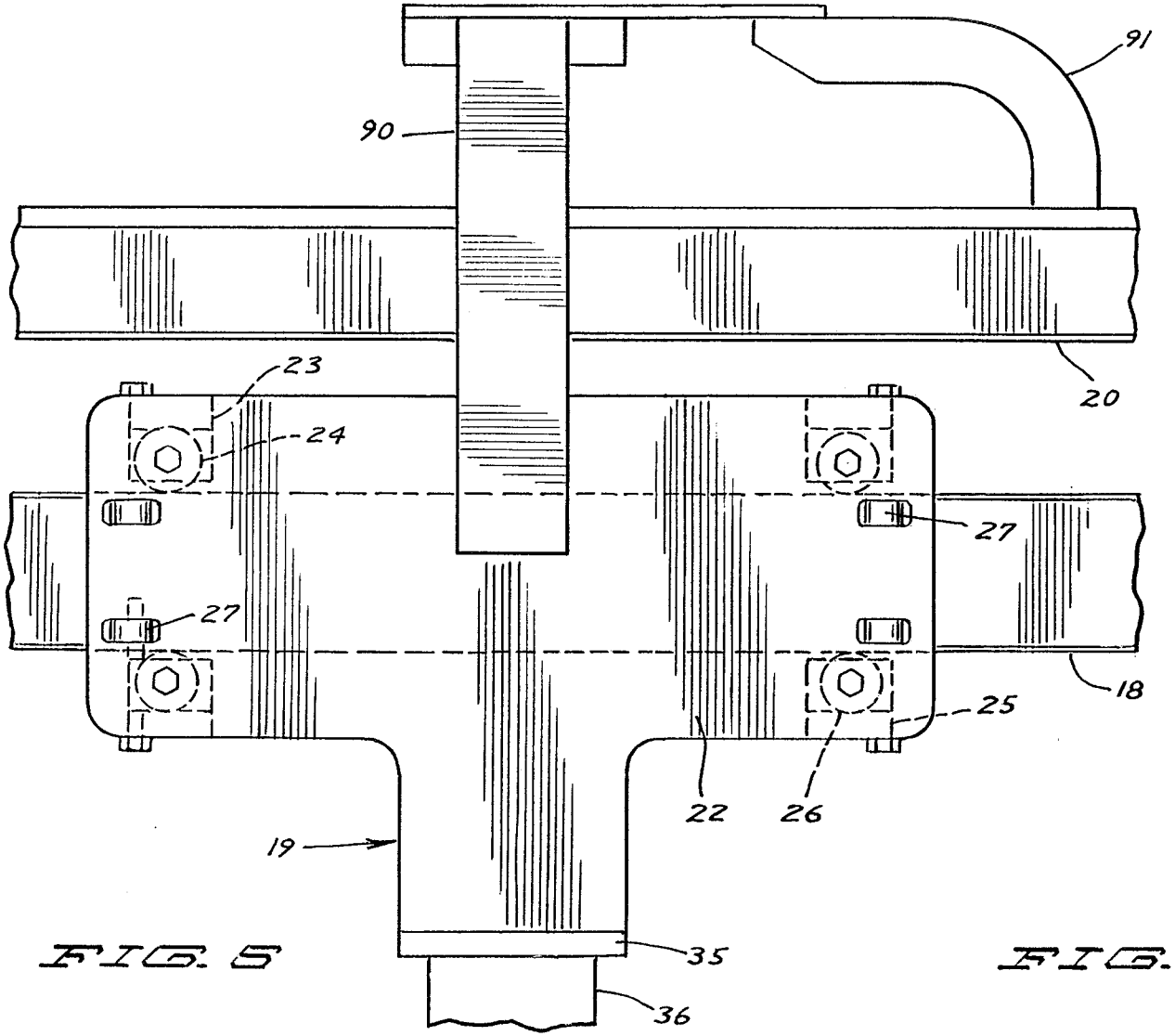
FIG. 5 is a side elevation on an enlarged scale of the carriage assembly by which a slicker element is positioned for movement above and relative to a wet hide supported on the bed of a vacuum hide drier.
Figure 10:
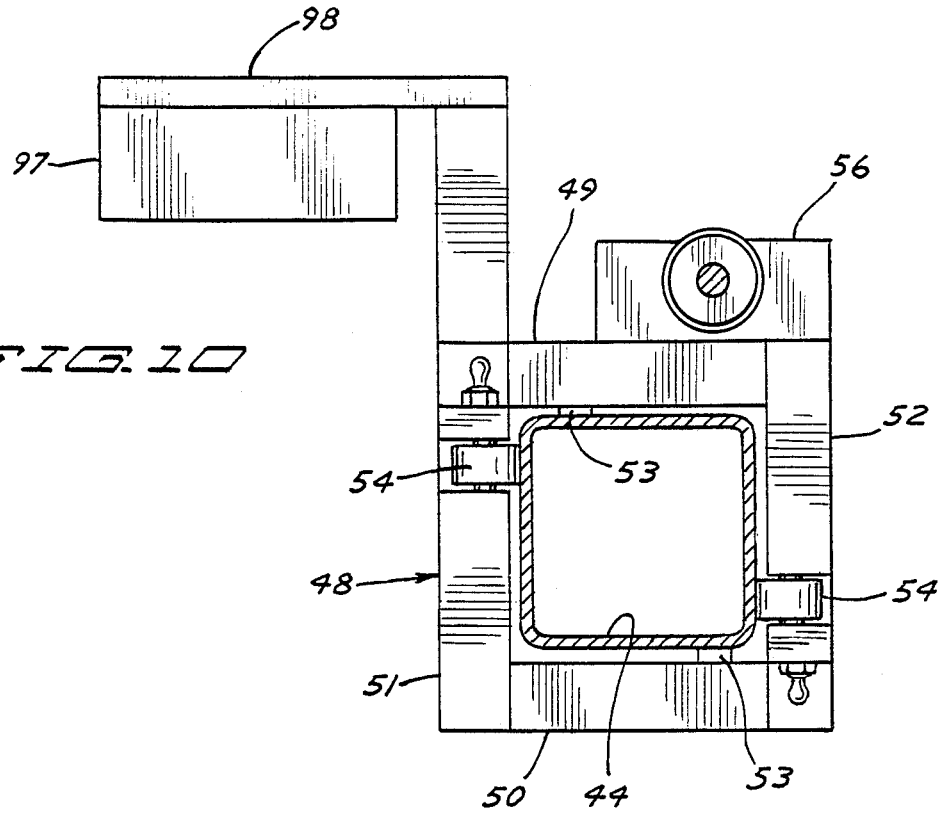
FIG. 10 is an end elevation thereof.
Figure 9:
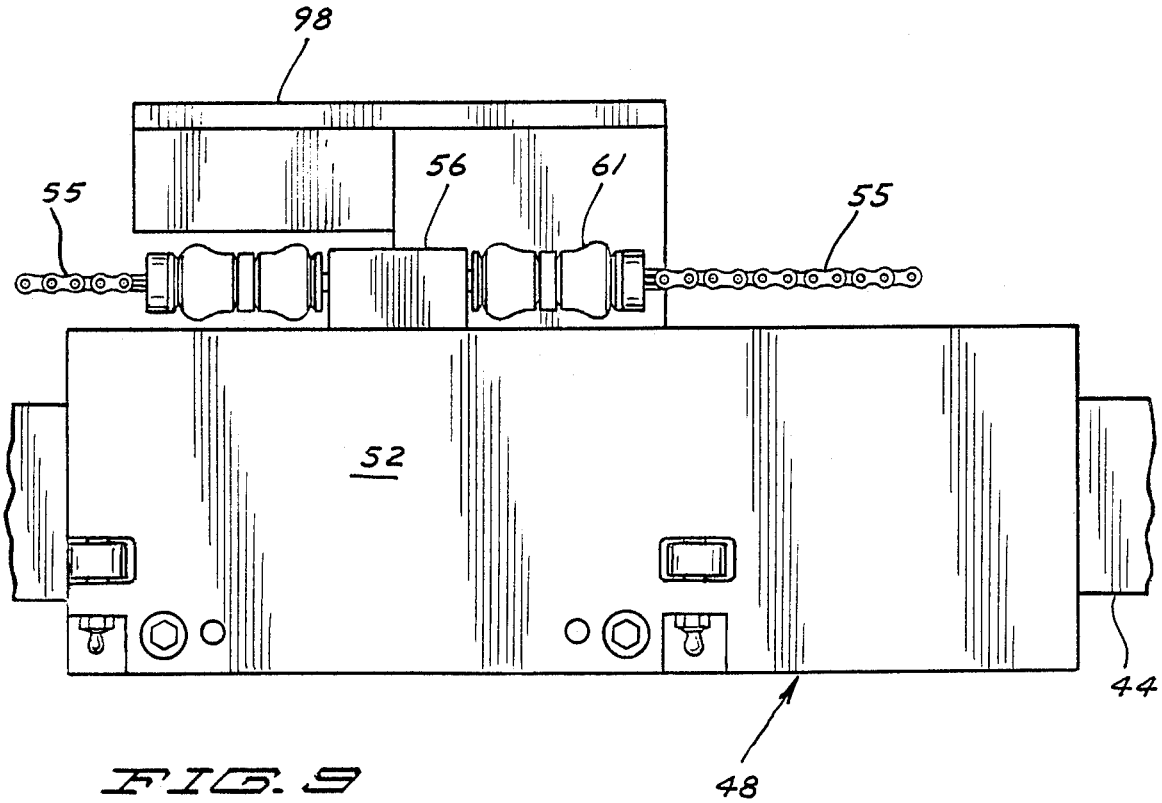
FIG. 9 is a side elevation of the slicker carriage of the carriage assembly.
Figure 12:
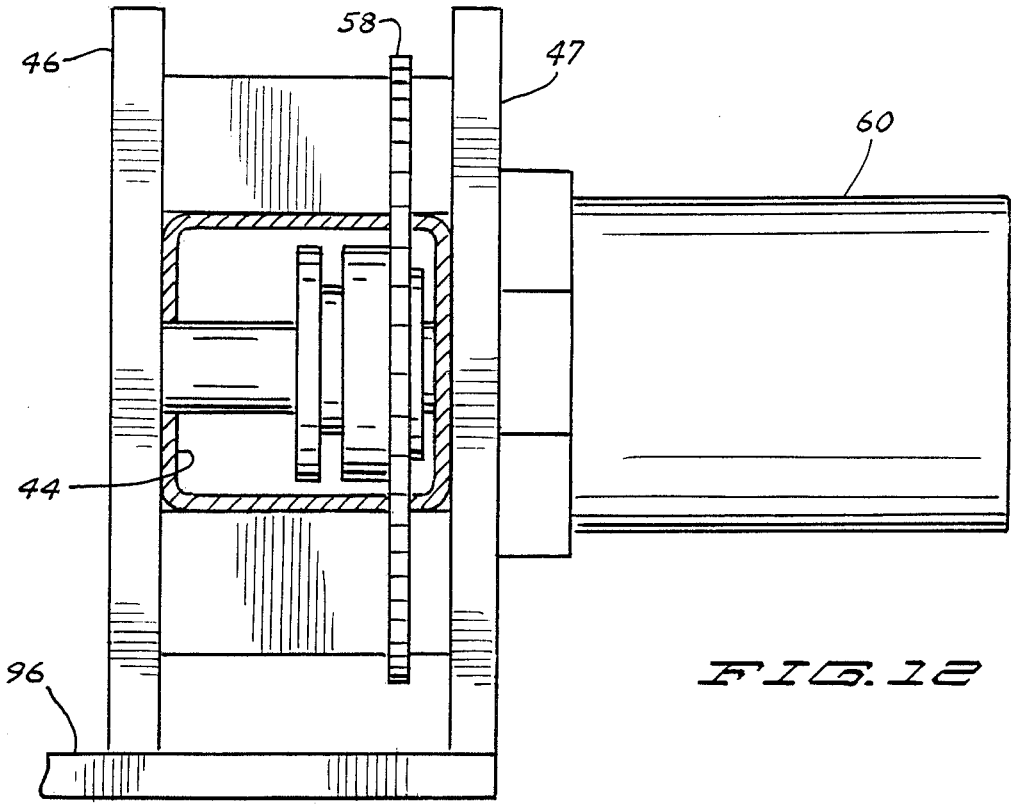
FIG. 12 is an end elevation thereof.
Figure 11:
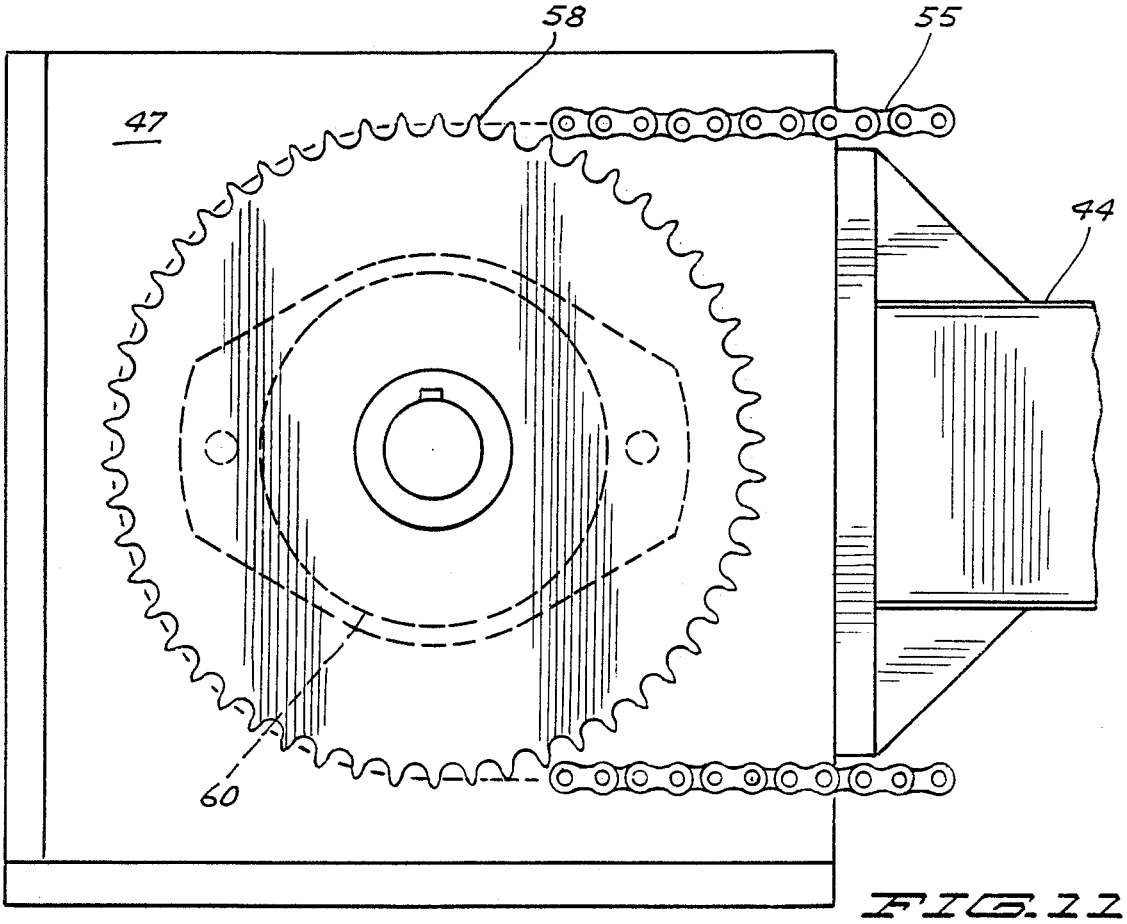
FIG. 11 is a side elevation of the drive assembly for the slicker carriage.

As best seen in FIGS. 5 through 7, carriage assembly 19 includes a support carriage housing comprising a pair of parallel spaced apart vertical plates 21 and 22 connected adjacent their top edges by a pair of horizontal cross members 23 each supporting a pair of rollers 24 for engagement with the top surface of track/beam 18 for supporting the carriage assembly for reciprocable movement along the track. A second pair of horizontal cross members 25 each supports a pair of rollers 26 for engagement with the bottom surface of track/beam 18. Additional guide rollers 27 are set in slots in the vertical side plates for engagement with the opposite sides of track/beam 18.

As seen in FIG. 1, for reciprocable movement of the entire carriage assembly 19, one end of a sprocket chain or similar linear drive means 28 is secured to one end of the carriage housing. The drive chain 28 extends horizontally to and around an idler sprocket 29 supported on the cross beam 16 and thence horizontally to a drive sprocket 31 supported by the opposite cross beam 17. The drive chain then extends back to the carriage housing where its opposite end is secured to the housing. The drive sprocket 31 is driven by an hydraulic or electric motor 33 which is also supported by the cross beam 17. Preferably the drive chain is connected to the carriage housing through shock absorbers. Preferably also, limit switches 34 are interposed in the path of the carriage 19 in its reciprocal movement so that the motor speed is reduced and the carriage decelerates as it approaches either end of its stroke. The support carriage provides for side to side movement or X motion of the slicker element.

The carriage housing includes a bottom plate 35 from which a cylindrical vertical boom tube 36 is supported. As seen in FIG. 8, the boom tube 36 includes an outer stationary member and an inner concentric tubular member 37 journaled for rotation in upper and lower ring bearings 38 and 39. The inner boom tube may be rotated manually to move the applicator into and out of operating position above the drier bed. Alternatively, the inner boom tube 37 may be driven for limited rotation, for example, by an hydraulic or electric motor 40 through gear 41 or equivalent transmission means.

As best seen in FIGS. 5 and 9 through 12, an elongated horizontal arm 44 is fixed to plate 45 at the bottom end of inner boom tube 37 for rotation therewith. One end of the horizontal arm 44 is rigidly secured to spaced apart plates 46 and 47 which in turn are rigidly secured to the bottom end of the boom tube. The horizontal arm 44 functions as a horizontal track for reciprocable movement along the track of a slicker carriage, indicated generally at 48. Slicker carriage 48 includes top and bottom walls 49 and 50, respectively, and side walls 51 and 52. Rollers 53 are supported in the top and the bottom walls of the carriage housing for engagement, respectively, with the top and bottom surfaces of arm 44 and rollers 54 in the side walls of the carriage engage the opposite sides of arm 44.

To accomplish reciprocal movement of the slicker carriage 48 along arm 44, one end of a sprocket chain 55 or similar linear drive means, is secured to a bracket 56 mounted on top of the carriage 48. The drive chain extends horizontally to and around idler sprockets supported in a bracket 57 on the end of the horizontal track/arm remote from its connection to the boom tube. The drive chain extends from the idlers horizontally to a drive sprocket 58 supported on a shaft between motor mount plates 46 and 47. The drive chain then extends back to the carriage where its opposite end is secured to the bracket 56. The drive sprocket is driven by an hydraulic or electric motor 60 which is supported on plate 47. The drive chain is preferably connected to the carriage through shock absorbing connector 61 and preferably limit switches 62 are provided in the path of the carriage for decelerating the rate of travel of the carriage at the opposite ends of the reciprocal stroke. The slicker carriage provides in and out movement or Y motion of the slicker element.

Figure 13:
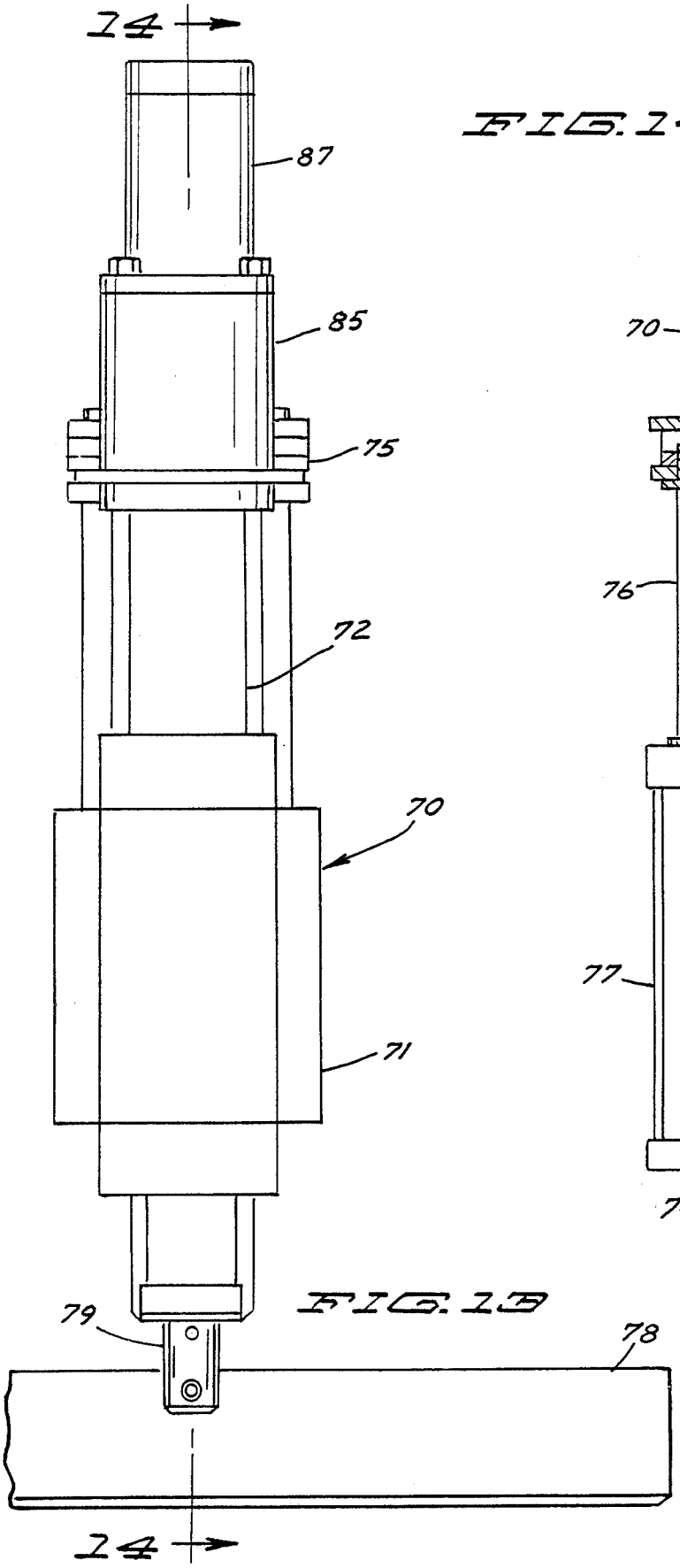
FIG. 13 is an elevation of the slicker assembly.
Figure 14:
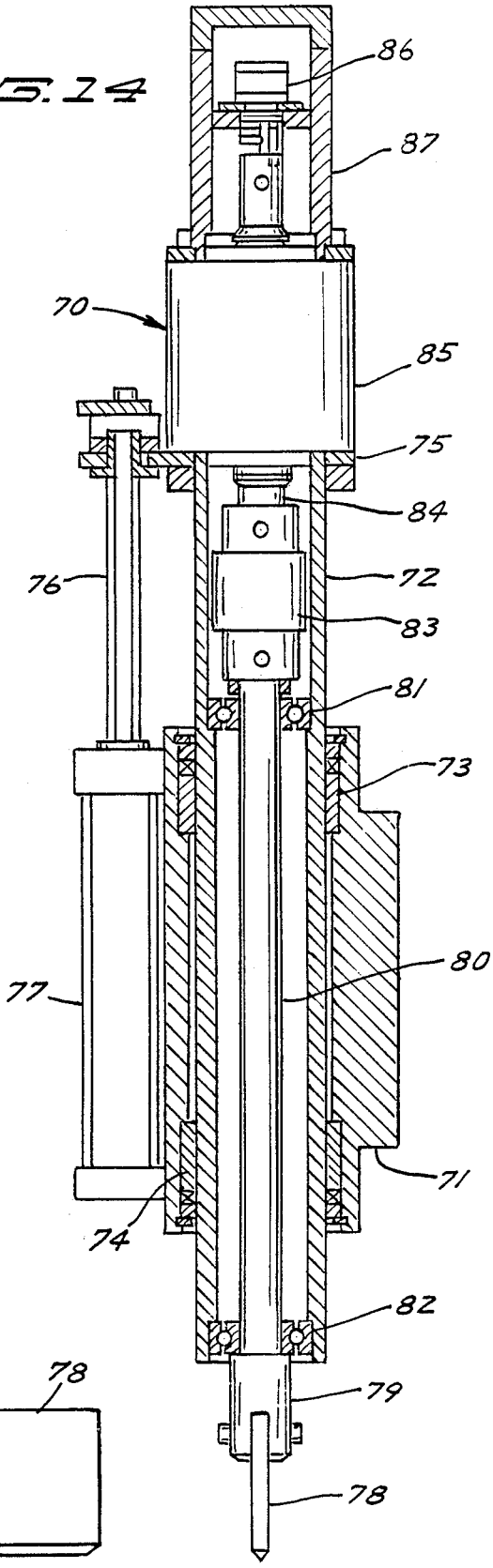
FIG. 14 is a section on the line 14—14 of FIG. 13 and in the direction of the arrows.

Referring now to FIGS. 5, 13 and 14, a slicker assembly, indicated generally at 70, is supported on slicker carriage 48 for reciprocal movement therewith along arm/track 44. A slicker head body 71 is rigidly secured to the outside surface of slicker carriage side wall 52 for movement therewith. A tubular shaft 72 is journaled within head body 71 in upper and lower sleeve bearings 73 and 74 for limited reciprocal movement relative to the body. A cap 75 is fixed to the top end of shaft 72 for movement therewith. The outermost end of the piston 76 of air cylinder 77 is secured to cap 75 to cause reciprocal movement of the shaft 72.

A slicker element in the form of a straight edge blade 78 is carried in a blade holder 79 at the lowermost end of a blade actuator shaft 80. Actuator shaft 80 is journaled for rotation within shaft 72 supported by upper and lower ring bearings 81 and 82 for reciprocal movement with shaft 72 and rotation relative to it. Actuator shaft 80 is connected by coupling 83 to the drive shaft 84 of hydraulic motor 85. Motor 85 is controlled through potentiometer 86 enclosed within housing 87 mounted on top of the motor and reciprocable with it.

Slicker blade 78 is disposed so as to be capable of applying pressure to a hide. It may be perpendicular to the hide as shown or may be disposed angularly relative to the surface of the drier bed and a hide carried by the bed in closer simulation of manual manipulation. Blade 78 is reciprocated toward and away from the hide in Z motion by action of cylinder 77 and an adjustable controllable thrusting force is exerted to hold the blade edge in contact with the hide by the cylinder which is connected to a source of air under pressure. The slicker assembly provides up and down or Z motion of the slicker element. Although preferably in the form of a blade, the slicker element may take the form of a small diameter elongated roller.

In order to prevent kinking, and to minimize the adverse effects of multiple flexing of the wires, cables, hoses, etc. associated with operation of the hide applicator due to movement of the support and slicker carriages, troughs or trays are provided for containing the slack in these lines. Tray 20 forms part of the support frame for the support carriage 19 (FIGS. 1 through 7). An inverted yoke 90 extends around and over tray 20 and supports one end of a flexible guide channel or guard 91 through which the cables etc. extend. Plastitrak sold by McGraw-Edison Company is one exemplary form of flexible guide channel or cable guard which may be used. A similar tray 95 is provided adjacent to horizontal arm 44 (FIG. 5) supported at one end from a bracket 96 on the slicker carriage motor mount (FIG. 12) and at the other by an extension from idler bracket 57. A similar flexible guide channel or guard 97 (FIG. 10) is secured to a bracket 98 extending outwardly from the slicker carriage and overlying the tray 95.

Figure 15:
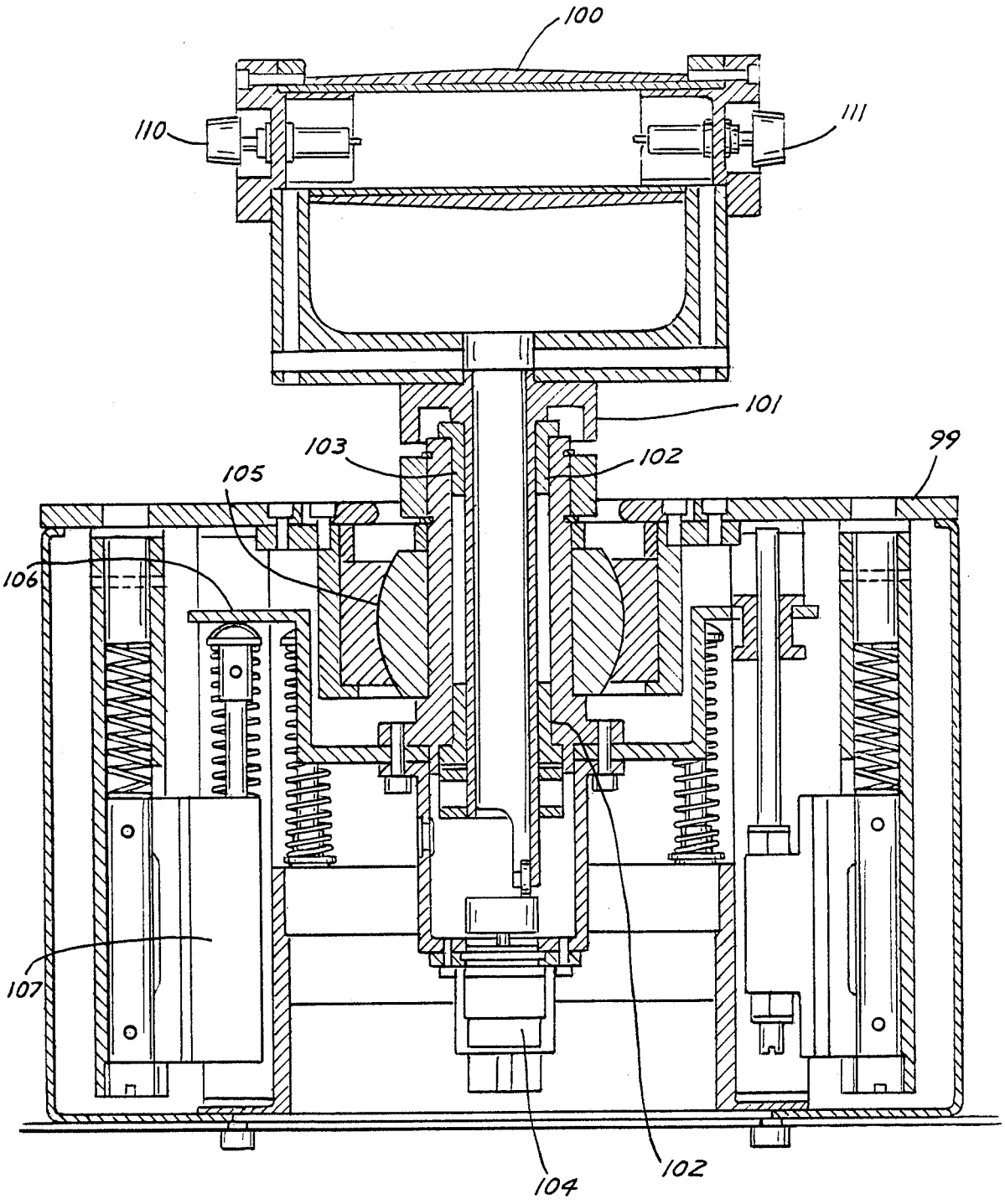
FIG. 15 is a sectional view of the control handle for the hide applicator.

Manually operable control means for motors 33 and 60 operating reciprocal movement of carriages 19 and 48, respectively, motor 85 operating rotation of the slicker element, and for flow of air to cylinder 77 to operate thrust motion of the slicker element, are preferably spaced apart from the applicator apparatus, but in close proximity so that the operator at all times may view the application operation. The control assembly is shown in FIG. 15. A T-bar joystick handle 100 is mounted on one end of a tubular shaft 101 which is journaled for rotation in bearings 102 within pivot housing 103. The opposite end of shaft 101 is connected to potentiometer 104 which is electrically connected to potentiometer 86 in the slicker assembly. Housing 103 in turn is supported within stationary housing 99 for universal pivotal movement in ball and socket bearing 105. Housing 103 supports an annular flange 106, the surface of which engages the ends of spring biased plungers of each of the linear motion potentiometers 107 controlling current to the operating motors. Thumb switches 110 or 111 actuate the system for flow of air to cylinder 77 for moving the slicker blade 78 into contact with a hide to be flattened and stretched.

Rotary movement of handle 100 translates into corresponding rotary movement of slicker blade 78. Right and left pivotal movement of the handle translates into corresponding movement of the support carriage along beam/track 18 and up and down pivotal movement of the handle translates into reciprocal movement of slicker carriage 48 along arm/track 44. The analogous control system of the aforesaid U.S. Pat. No. 4,596,124 may alternatively be used for operating the hide applicator of the present invention.

Figure 16:
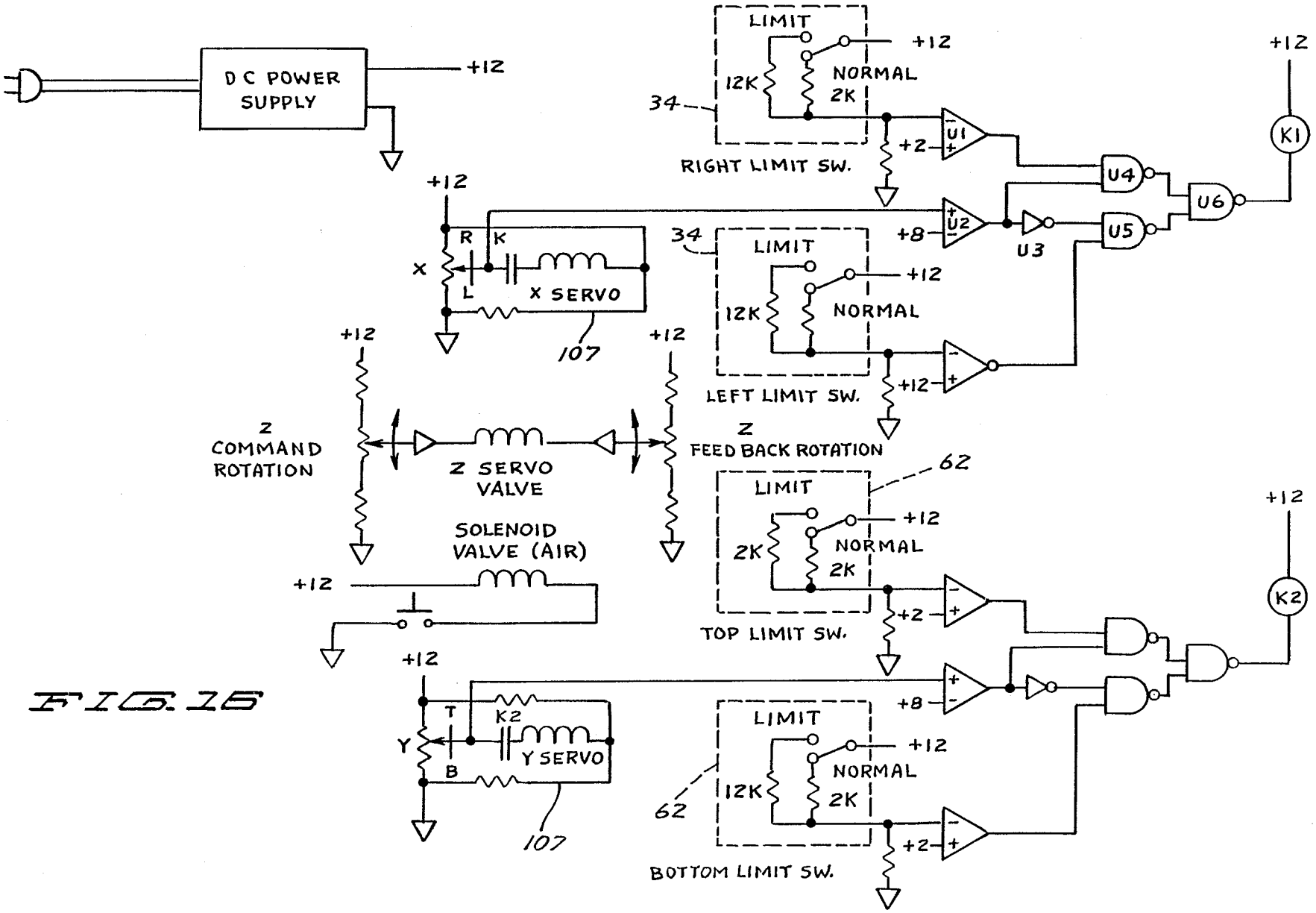
FIG. 16 is a schematic diagram of the control circuit for the hide applicator.
Figure 27:
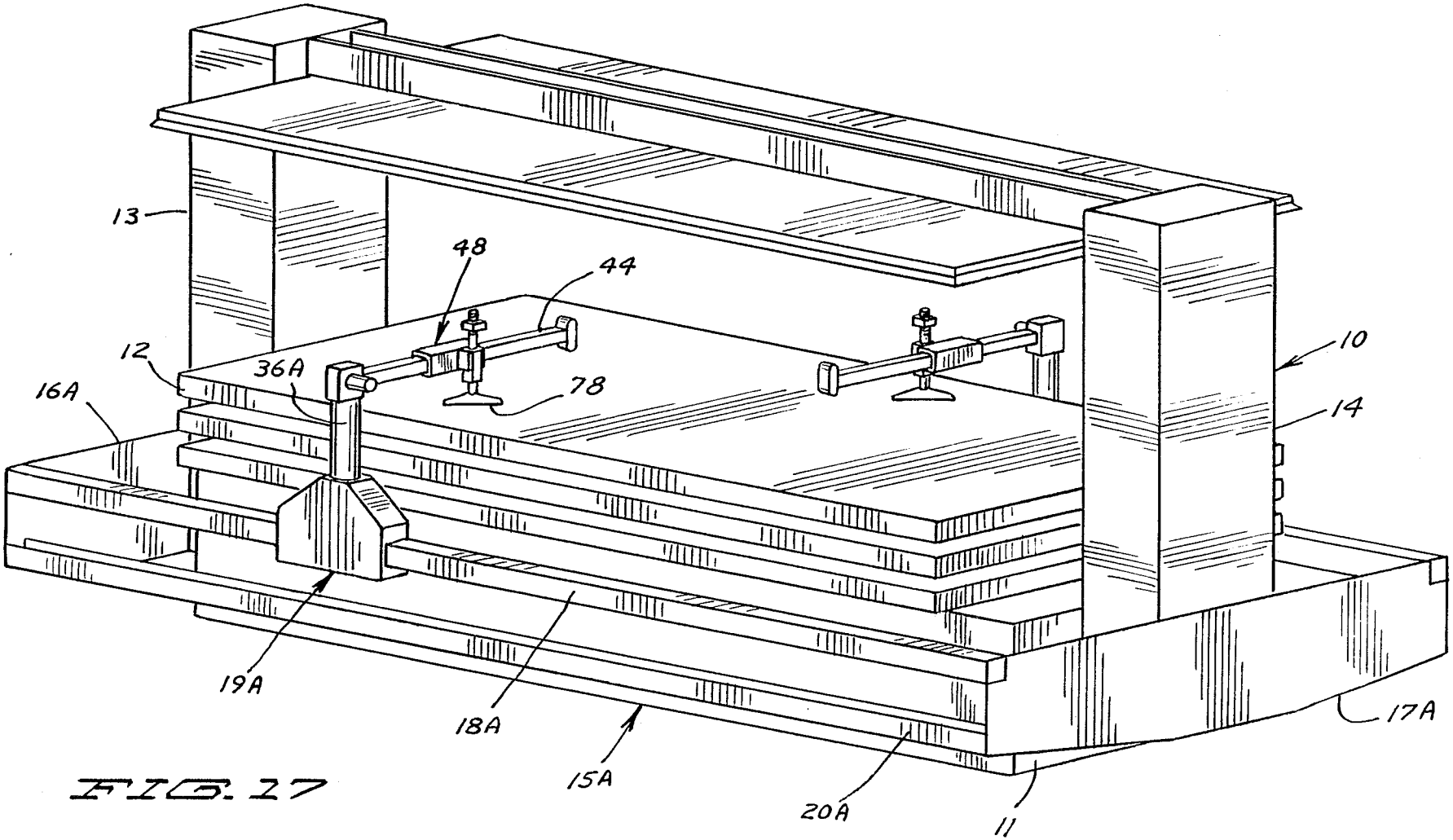

FIG. 16 illustrates the electrical control circuit. The X and Y potentiometers 107 are rate controlled systems. With the potentiometer wiper in the mid-position of its throw, no current will flow in to the associated servo valve, thus no X or Y actuator movement. Upon moving the wiper from its mid-position, responsive to movement of the joystick, current will flow in the servo valve, thus causing X or Y or both X and Y actuator movement. The farther the deviation of the wiper from its mid-position, the greater the current flow, causing a higher rate of actuator movement. Reversing the movement of the wiper to the other side of mid-position on the potentiometer reverses the current flow direction through the servo valve, causing the X or Y, or both, actuator movement in the opposite direction.

Two limit switches 34 are provided for the X actuator (carriage 19) and two limit switches 62 are provided for the Y actuator (carriage 48) to detect end of travel. The limit switches are proximity switches that detect the presence or absence of metal. If the X actuator reaches end of travel, relay contact K1 (located in series with the servo valve) will open, causing zero current flow through the servo valve and the actuator will come to a stop, preventing damage to the structure. Conversely, if the Y actuator reaches end of travel, relay contact K2 will open, causing the Y actuator to come to a stop. During normal operation the limit switches and associated logic will cause relays K1 and K2 to be energized (will allow current flow through the servo valves). If one of the limit switches detects the presence of metal (end of travel) a comparator U1 (connected to the limit switch) will output a logic "1" causing the output of a nand gate U4 to switch from a logic "1" to a logic "0" which in turn will cause the final nand gate U6 to switch from a logic "0" to a logic "1", thus de-energizing the relay. Reversing the direction of the joystick potentiometer will again energize the relay through nand gate U5, inverter U3 and comparator U2, allowing the actuator to be moved out of the end of travel limit.

The Z rotation control is a closed loop servo circuit. A potentiometer 104 on the joystick provides the Z rotation command and a potentiometer 86 on the Z rotation actuator (shaft 80) provides the Z rotation feedback. Whenever the position of the Z rotation command potentiometer 104 is changed an appropriate current will flow through the Z servo valve causing the Z rotation feedback to equal the Z rotation command (zero error). Driving the Z rotation actuator 80 correspondingly drives the slicker element 78.

FIG. 17 shows an alternative form of support for a hide applicator according to the present invention. The typical vacuum drier 10 is identical to that already described. The modified support frame 15A is mounted below the drier bed and comprises a pair of end cross beams 16A and 17A supporting a pair of horizontal longitudinal beams 18A which function as a track for reciprocal movement of a carriage assembly 19A, generally as previously described. The difference is that horizontal arm 44 is supported above the vacuum drier bed 12 from carriage assembly 19A by means of an upwardly extending vertical boom tube 36A. Apart from these differences, the overall structure and operation of the hide applicator apparatus is as already described.

The form of vacuum drier illustrated in FIGS. 1 through 4 and 17 is intended for the simultaneous drying of four hides per bed. These hides are ordinarily applied by operators working simultaneously on each side of the bed applying and removing hides. For smaller driers, the support frame may include a single longitudinal beam/track supported above and adjacent to the drier bed, or it may be a free-standing single track frame adapted for positioning alongside and adjacent to a drier without being physically attached thereto.

Figure 18:
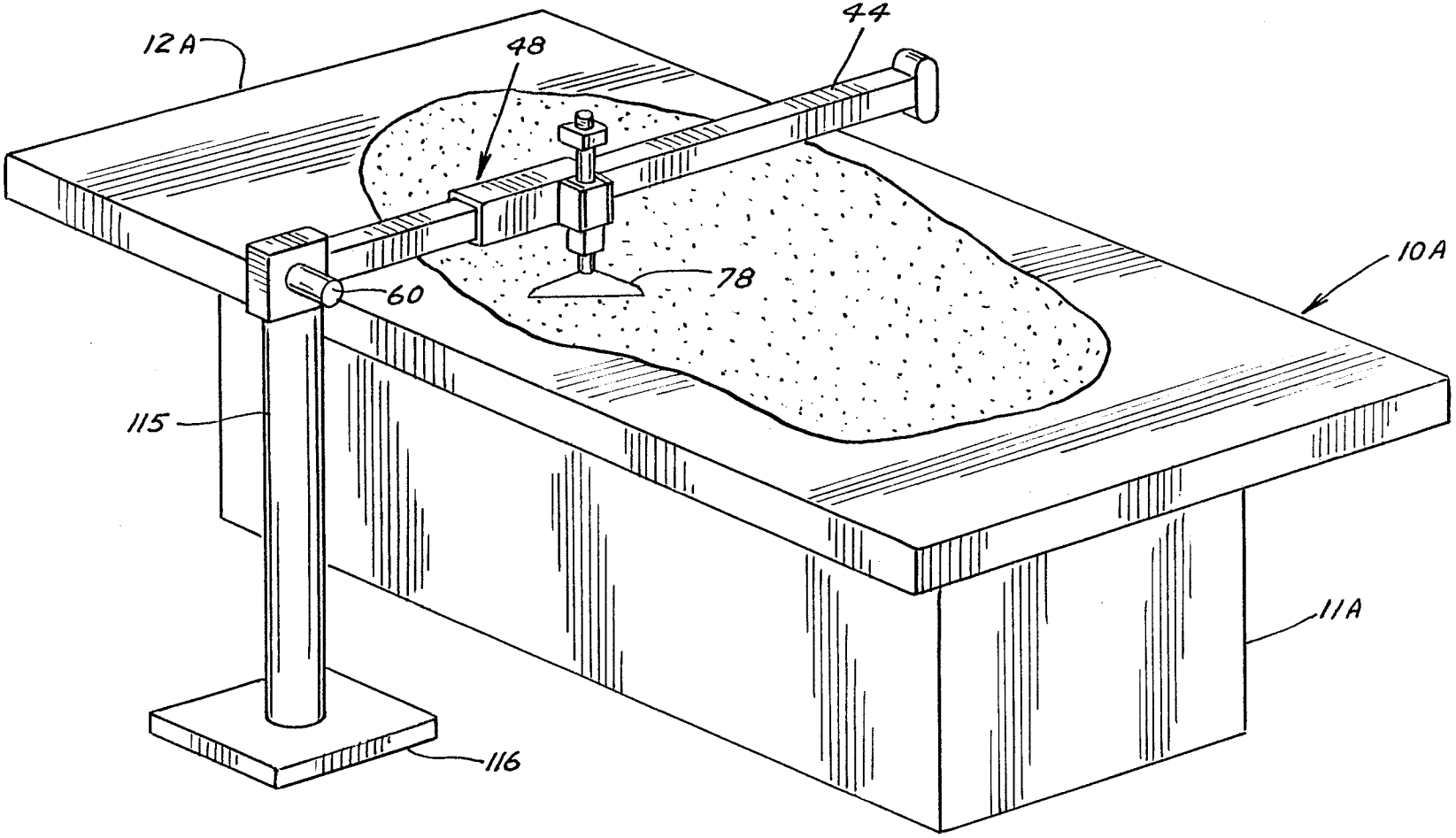
FIG. 18 is a perspective view of a further alternative form of hide applicator mounted on a floor supported pedestal.

Referring to FIG. 18, there is shown a further alternative form of mounting support for the hide applicator arm/track 44. This form of applicator apparatus is for use with an alternative form of smaller vacuum hide drier 10A having a flat drier bed 12A supported on a base housing 11A. The vacuum head is not shown. In this instance, the horizontal arm/track 44 is supported by a vertical standard or pedestal 115 which in turn is supported by a floor mounted base 116. The pedestal standard is positioned closely adjacent to the edge of the drier bed 12A. Base 116 may be stationary or may be movable, mounted on casters or the like. Arm/track 44 is rotatably mounted at the top of the pedestal standard 115. Manipulation of the slicker element 78 is the result of the combination of pivotal rotation of the arm/track above the hide surface and reciprocal movement of the slicker carriage 48. The structure of the arm/track 44 and slicker carriage 48 and associated mechanisms are otherwise as previously described.

It is apparent that many modifications and variations of this invention as hereinbefore set forth may be made without departing from the spirit and scope thereof. The specific embodiments described are given by way of example only and the invention is limited only by the terms of the appended claims.

We claim:

1. A power assist hide applicator apparatus for flattening and stretching a wet hide against the smooth horizontal planar surface of the flat bed of a vacuum hide drier upon which a hide is applied for subsequent drying on the bed according to conventional tannery practice, said apparatus being adapted for positioning adjacent to the bed of a vacuum drier, said apparatus comprising:

(A) an elongated horizontal arm, said arm comprising a horizontal slicker support rotatable out of and into position above and closely adjacent to the upper surface of the drier bed;

(B) support means for said horizontal arm, said support means being adapted for positioning spaced from but adjacent to the bed of a vacuum drier;

(C) a rotary connection between said support means and one end of said horizontal arm whereby said arm is rotatable in a plane parallel to and closely adjacent to the upper surface of the drier bed;

(D) means for rotating said arm relative to said support means;

(E) means supporting a slicker element from said horizontal arm, said slicker element having a smooth straight edge rotatable in a plane parallel to the surface of the drier bed;

(F) separate motor power means associated with the slicker element for rotating the same;

(G) further separate independent power thrust drive means associated with the slicker element for moving the element into and out of contact with a wet hide carried on the bed, and exerting force on the slicker element; and (H) electric control means for actuating the several power means for manipulating the slicker element over the surface of a hide in simulation of manual hide application.

2. A power assist hide applicator apparatus according to claim 1 wherein:

(A) said horizontal arm comprises a horizontal slicker track;

(B) a slicker carriage is mounted on said track for reciprocation along the track; and (C) separate motor power means are provided for reciprocating said carriage.

3. A power assist hide applicator apparatus according to claim 1 wherein:

(A) said support means for the horizontal arm comprises at least one elongated horizontal longitudinal support track adapted to be positioned adjacent to the flat bed of the drier, said track being spaced parallel to the edge of the drier bed;

(B) a support carriage is mounted for reciprocable movement along said support track;

(C) separate motor power means are provided for reciprocating said support carriage; and (D) a vertical boom tube is attached to said support carriage.

4. A power assist hide applicator apparatus according to claim 3 wherein said support means for the horizontal arm comprises a frame generally proportionate to the flat bed of the drier, and adapted to be positioned adjacent to said bed; said support track extending along one side edge of said support frame.

5. A power assist hide applicator apparatus according to claim 4 wherein said frame is adapted to be supported above the drier bed.

6. A power assist hide applicator apparatus according to claim 4 wherein said frame is adapted to be supported below the drier bed.

7. A power assist hide applicator apparatus according to claim 2 wherein:

(A) said support means for the slicker element comprises a head body secured to said slicker carriage and having a tubular shaft journaled for limited reciprocal movement relative thereto;

(B) the motor drive means for rotating the slicker element is supported at one end of said tubular shaft for reciprocal movement therewith;

(C) an actuator shaft connected at one end to said motor drive means extends through said tubular shaft journaled for rotation relative thereto;

(D) the slicker element is supported at the opposite end of said actuator shaft, and (E) said power thrust drive means reciprocate said tubular shaft and slicker element.

8. A power assist hide applicator apparatus according to claim 7 wherein said reciprocation drive means comprises at least one fluid actuated piston.

9. A power assist hide applicator apparatus according to claim 7 wherein said slicker element is a blade.

10. A power assist hide applicator apparatus according to claim 1 wherein:

(A) said control means is manually operable and comprises a handle journaled for rotation within a pivot housing;

(B) said pivot housing is pivotally supported within a stationary housing for universal pivotal movement.

(C) a switch is provided in said handle.

11. A power assist hide applicator apparatus according to claim 10 wherein:

(A) electrical connection means between said handle and said motor drive means for the slicker element causes rotation of said slicker element responsive to rotation of the handle;

(B) electrical connection means between said pivot housing and said support and slicker carriages causes movement of said carriages responsive to pivotal movement of said handle and pivot housing; and (C) electrical connection means between said handle switch and said thrust means causes reciprocable movement of the slicker element responsive to actuation of said switch.

12. A power assist hide applicator apparatus for flattening and stretching a wet hide against the smooth horizontal planar surface of the flat bed of a vacuum hide drier upon which a hide is applied for subsequent drying on the bed according to conventional tannery practice, said apparatus being adapted for mounting adjacent to the bed of a vacuum drier, said apparatus comprising:

(A) a support frame generally proportionate to the flat bed of the drier, and adapted to be positioned spaced from but adjacent to said bed;

(B) at least one elongated horizontal longitudinal support track along one side edge of said support frame, said track being spaced parallel to the corresponding edge of the drier bed;

(C) a support carriage mounted for reciprocable movement along said track;

(D) motor power means for reciprocating said support carriage;

(E) an elongated horizontal arm comprising a horizontal slicker track rotatable out of and into position above and closely adjacent to the upper surface of the drier bed;

(F) a rotary connection between said support carriage and one end of said horizontal arm whereby said arm is rotatable in a plane parallel to and closely adjacent to the upper surface of the drier bed;

(G) means for rotating said arm relative to said support carriage;

(H) a slicker carriage reciprocable along said slicker track;

(I) separate motor power means for reciprocating said slicker carriage;

(J) means supporting a slicker element from said slicker carriage, said slicker element having a smooth straight edge rotatable in a plane parallel to the surface of the drier bed;

(K) separate motor power means associated with the slicker element for rotating the same;

(L) further separate independent power thrust drive means associated with the slicker element for moving the element into and out of contact with a wet hide carried on the bed, and exerting force on the slicker element; and (M) electric control means for actuating the several power means for manipulating the slicker element over the surface of a hide in simulation of manual hide application.

13. A power assist hide applicator apparatus according to claim 12 wherein said rotary connection comprises a vertical boom tube attached at one end to said support carriage.

14. A power assist hide applicator apparatus according to claim 13 wherein said support frame is adapted to be mounted above the drier bed and said boom tube is suspended from the support carriage.

15. A power assist hide applicator apparatus according to claim 12 wherein:

(A) said support means for the slicker element comprises a head body secured to said slicker carriage and having a tubular shaft journaled for limited reciprocal movement relative thereto;

(B) the motor drive means for rotating the slicker element is supported at one end of said tubular shaft for reciprocal movement therewith;

(C) an actuator shaft connected at one end to said motor drive means extends through said tubular shaft journaled for rotation relative thereto;

(D) the slicker element is supported at the opposite end of said actuator shaft, and (E) said power thrust drive means reciprocate said tubular shaft and slicker element.

16. A power assist hide applicator apparatus according to claim 15 wherein said reciprocation drive means comprises at least one fluid actuated piston.

17. A power assist hide applicator apparatus according to claim 15 wherein said slicker element is a blade.

18. A power assist hide applicator apparatus according to claim 12 wherein:

(A) said control means is manually operable and comprises a handle journaled for rotation within a pivot housing;

(B) said pivot housing is pivotally supported within a stationary housing for universal pivotal movement;

(C) a switch is provided in said handle.

19. A power assist hide applicator apparatus according to claim 18 wherein:

(A) electrical connection means between said handle and said motor drive means for the slicker element causes rotation of said slicker element responsive to rotation of the handle;

(B) electrical connection means between said pivot housing and said support and slicker carriages causes movement of said carriages responsive to pivotal movement of said handle and pivot housing; and (C) electrical connection means between said handle switch and said thrust means causes reciprocable movement of the slicker element responsive to actuation of said switch.

20. A power assist hide applicator apparatus for flattening and stretching a wet hide against the smooth horizontal planar surface of the flat bed of a vacuum hide drier upon which a hide is applied for subsequent drying on the bed according to conventional tannery practice, said apparatus being adapted for mounting adjacent to the bed of a vacuum drier, said apparatus comprising:

(A) a support frame generally proportionate to the flat bed of the drier, and adapted to be positioned above said bed;

(B) at least one elongated horizontal longitudinal support track along one side edge of said support frame, said track being spaced parallel to the corresponding edge of the drier bed;

(C) a support carriage mounted for reciprocable movement along said track;

(D) motor power means for reciprocating said support carriage;

(E) an elongated horizontal arm comprising a horizontal slicker track rotatable into position above and closely adjacent to the upper surface of the drier bed;

(F) a rotary connection between said support carriage and one end of said horizontal arm whereby said arm is rotatable in a plane parallel to and closely adjacent to the upper surface of the drier bed, said rotary connection including a vertical boom tube suspended from said support carriage;

(G) means for rotating said arm relative to said support carriage;

(H) a slicker carriage reciprocable along said slicker track;

(I) separate motor power thrust drive means for reciprocating said slicker carriage;

(J) means supporting a slicker element from said slicker carriage, said slicker element having a smooth straight edge rotatable in a plane parallel to the surface of the drier bed;

(K) separate motor power means associated with the slicker element for rotating the same;

(L) further separate independent power thrust means associated with the slicker element for moving the element vertically into and out of contact with a wet hide carried on the bed, and exerting force on the slicker element; and (M) electric control means for actuating the several power means for manipulating the slicker element over the surface of a hide in simulation of manual hide application.

21. A power assist hide applicator apparatus according to claim 20 wherein:

(A) said support means for the slicker element comprises a head body secured to said slicker carriage and having a tubular shaft journaled for limited reciprocal movement relative thereto;

(B) the motor drive means for rotating the slicker element is supported at one end of said tubular shaft for reciprocal movement therewith, (C) an actuator shaft connected at one end to said motor drive means extends through said tubular shaft journaled for rotation relative thereto;

(D) the slicker element is supported at the opposite end of said actuator shaft; and (E) said power thrust drive means reciprocate said tubular shaft and slicker element.

22. A power assist hide appliccator apparatus according to claim 21 wherein said reciprocation drive means comprises at least one fluid actuated piston.

23. A power assist hide applicator apparatus according to claim 21 wherein said slicker element is a blade.

24. A power assist hide applicator apparatus according to claim 20 wherein:

(A) said control means is manually operable and comprises a handle journaled for rotation within a pivot housing;

(B) said pivot housing is pivotally supported within a stationary housing for universal pivotal movement;

(C) a switch is provided in said handle.

25. A power assist hide applicator apparatus according to claim 24 wherein:

(A) electrical connection means between said handle and said motor drive means for the slicker element causes rotation of said slicker element responsive to rotation of the handle;

(B) electrical connection means between said pivot housing and said support and slicker carriages causes movement of said carriages responsive to pivotal movement of said handle and pivot housing; and (C) electrical connection means between said handle switch and said thrust means causes reciprocable movement of the slicker element responsive to actuation of said switch.

* * * * *